US006816697B2

(12) United States Patent
Suto et al.

(10) Patent No.: US 6,816,697 B2
(45) Date of Patent: Nov. 9, 2004

(54) IMAGE FORMING APPARATUS WITH CLEANING UNIT

(75) Inventors: Masaki Suto, Iwatsuki (JP); Hiroyuki Mitsu, Iwatsuki (JP); Koji Miyake, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/368,648

(22) Filed: Feb. 20, 2003

(65) Prior Publication Data

US 2004/0033089 A1 Feb. 19, 2004

(30) Foreign Application Priority Data

Jun. 10, 2002 (JP) ..... 2002-169261

(51) Int. Cl.[7] ..... G03G 15/16
(52) U.S. Cl. ..... 399/297; 399/302; 399/308
(58) Field of Search ..... 399/101, 297, 399/302, 308, 350, 353–355, 357

(56) References Cited

U.S. PATENT DOCUMENTS 4,935,788 A * 6/1990 Fantuzzo et al. ..... 399/302
5,087,945 A * 2/1992 Randall ..... 399/302
5,130,755 A * 7/1992 Ikegawa et al. ..... 399/350

FOREIGN PATENT DOCUMENTS

JP A 6-148910 5/1994
JP A 10-274889 10/1998
JP 2001075448 A * 3/2001 ..... G03G/15/16
JP 2001109351 A * 4/2001 ..... G03G/15/16

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

Disclosed is an image forming apparatus in which an increase in the service life is compatible with a reduction in apparatus size and cost and which provides high productivity in image formation. The image forming apparatus includes: an image bearing member; an image forming unit; an intermediate transfer device; a final transfer member; a potential gradient forming unit; and a cleaning unit; an upstream side cleaning roll, a downstream side cleaning roll which is in contact with the intermediate transfer member on the downstream side of the upstream side cleaning roll with respect to a feedback direction in which the residual toner is fed back from the final transfer position to the primary transfer position, and a cleaning brush which is in contact with the intermediate transfer member on the downstream side of the upstream side cleaning roll and on the upstream side of the downstream side cleaning roll.

8 Claims, 6 Drawing Sheets

IMAGE FORMING APPARATUS WITH CLEANING UNIT

FIELD OF THE INVENTION AND RELATED ART STATEMENT

The present invention relates to an electrophotographic image forming apparatus, such as a copying machine, a printer, a facsimile, or a multifunction apparatus formed by combining them, and in particular, to an improvement in a cleaning technique for an image forming apparatus.

Up to now, electrophotographic (electrostatic transfer type) image forming apparatuses, such as copying machines and printers, have been widely known. In such image forming apparatuses, a toner image is transferred to a recording sheet by a final transfer member, and then the toner image is fixed to thereby realize on the recording sheet the toner image as a permanent image. The portion of the toner that is not transferred to the recording sheet has to be removed by a cleaning device in the image forming apparatus. As a method for removing such residual toner, there have been proposed a technique in which a blade is used (See, for example, JP6-148910A), a technique in which a brush is used (See, for example, JP 10-274889 A), and so on.

However, these conventional techniques have the following problem.

When a blade is used, cleaning is performed with the blade being held in press contact with an intermediate transfer member, so that wear of the intermediate transfer member progresses after use over a relatively short period of time, so that the service life of the intermediate transfer member is rather short. Further, a surface flaw of the intermediate transfer member generated through wear may cause disturbance in the toner image. In particular, when a spherical toner produced by polymerization is used as the toner for forming the toner image, it is difficult to maintain a satisfactory cleaning performance.

When a brush is used, in order to remove residual toner from the brush, it is necessary for the cleaning device to be provided with, apart from the brush, a detoner roll (a roll for transferring residual toner), a flicker member (a member for shaking off residual toner) or the like, which is rather disadvantageous in terms of space efficiency and cost. Instead of using a detoner roll or a flicker member, it might be possible to adopt an arrangement in which residual toner is temporarily retained by the brush and in which apart from the image formation mode, there is provided a special cleaning mode in which the temporarily retained toner is carried to a residual toner recovery portion by utilizing a potential gradient. However, that would involve frequent operation of the cleaning mode, thus impairing the productivity in continuous image formation.

OBJECT AND SUMMARY OF THE INVENTION

The present invention has been made in view of the above-mentioned technical problem, and provides an image forming apparatus in which an increase in the service life of the intermediate transfer member is compatible with a reduction in apparatus size and cost and which provides high productivity in image formation.

Therefore, according to an aspect of the present invention, an image forming apparatus includes: an image bearing member; an image forming unit which forms a toner image on the surface of the image bearing member; an intermediate transfer device formed by at least one intermediate transfer member and which is in contact with the image bearing member at a primary transfer position; a final transfer member which is in contact with the intermediate transfer device at a final transfer position; a potential gradient forming unit which forms a potential gradient between the image bearing member, the intermediate transfer member, and the final transfer member so as to transfer the toner image to the final transfer position; and a cleaning unit which removes residual toner on the intermediate transfer member that is not finally transferred to a recording sheet at the final transfer position. In the apparatus, the cleaning unit includes: an upstream side cleaning roll which is in contact with the intermediate transfer member, a downstream side cleaning roll which is in contact with the intermediate transfer member on the downstream side of the upstream side cleaning roll with respect to a feedback direction in which the residual toner is fed back from the final transfer position to the primary transfer position, and a cleaning brush which is in contact with the intermediate transfer member on the downstream side of the upstream side cleaning roll with respect to the feedback direction and on the upstream side of the downstream side cleaning roll with respect to the feedback direction.

In this way, the blade is not held in press contact with the intermediate transfer member, so that wear of the intermediate transfer member does not progress easily, thus making the service life of the intermediate transfer member relatively long. Further, there is no need to provide a detoner roll (a roll for transferring residual toner), a flicker member (a member for shaking off residual toner) or the like for the cleaning brush, which is advantageous in terms of space efficiency and cost. Further, since this cleaning brush is placed between an upstream side cleaning roll and a downstream side cleaning roll, it is possible to remove residual toner without providing any special cleaning mode, and there is no fear of the productivity in image formation being impaired.

Here, the image forming apparatus according to the present invention may be structured such that the upstream side cleaning roll and the downstream side cleaning roll are all formed of conductive members, and that the potential gradient forming unit applies to one cleaning roll a high cleaning roll bias voltage higher than the surface potential of the intermediate transfer member which is in contact with the cleaning roll, and applies to the other cleaning roll a low cleaning roll bias voltage lower than the surface potential of the intermediate transfer member which is in contact with the cleaning roll.

Further, the image forming apparatus according to the present invention maybe structured such that the potential gradient forming unit applies to the cleaning brush a cleaning brush bias voltage which is on the side closer to the side of the cleaning roll bias voltage to be applied to the upstream side cleaning roll as compared with the surface potential of the intermediate transfer member which is in contact with the cleaning brush.

Further, the image forming apparatus according to the present invention may be structured such that the cleaning unit is equipped with a cleaning blade which scrapes off residual toner adhering to the (upstream side and/or downstream side) cleaning roll(s) and a take-out mechanism which takes out the residual toner scraped off by the cleaning blade. Furthermore, the cleaning roll and the cleaning blade may be formed of metal.

Further, the present invention is applicable not only to a monochrome image forming apparatus, but also to a multicolor image forming apparatus. That is, it is possible to adopt a construction which has as the image bearing member plural image bearing members for different colors and has as the intermediate transfer device a single intermediate transfer member. It is also possible to adopt a construction which has as the image bearing member plural image bearing members for different colors and has as the intermediate transfer device a first upstream side intermediate transfer member which is in contact with a part of the plural image bearing members, a first downstream side intermediate transfer member which is in contact with the remaining ones of the plural image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, the final transfer member being in contact with the second intermediate transfer member.

As a specific construction of the latter image forming apparatus, it is possible to adopt a construction such that the image forming apparatus includes: as the image bearing member four image bearing members for yellow, magenta, cyan, and black; and as the intermediate transfer device a first upstream side intermediate transfer member and a first downstream side intermediate transfer member respectively in contact with two of the four image bearing members, and a second intermediate transfer member which is in contact with the first upstream side intermediate transfer member and the first downstream side intermediate transfer member and to which a toner image is transferred from the first downstream side intermediate transfer member after the transfer of a toner image from the first upstream side intermediate transfer member, in which the final transfer member is in contact with the second intermediate transfer member.

In this image forming apparatus, the upstream side cleaning roll abuts against the second intermediate transfer member, and the downstream side cleaning roll may be exclusively in contact with the first upstream side intermediate transfer member or exclusively in contact with the first downstream side intermediate transfer member; there may be provided as the downstream side cleaning roll two downstream side cleaning rolls, one of which is in contact with the first upstream side intermediate transfer member and the other of which is in contact with the first downstream side intermediate transfer member.

Further, this image forming apparatus may have as the cleaning brush only an upstream side cleaning brush which is in contact with the second intermediate transfer member and a downstream side cleaning brush which is in contact with the first upstream side intermediate transfer member, or only a downstream side cleaning brush which is in contact with the first downstream side intermediate transfer member; or, it may have as the downstream side cleaning brush two cleaning brushes, one of which is in contact with the first upstream side intermediate transfer member and the other of which is in contact with the first downstream side intermediate transfer member.

Further, of the intermediate transfer member, the cleaning roll abutting against the intermediate transfer member, and the cleaning brush abutting against the intermediate transfer member, at least two may receive application of bias voltage from the same power source. Specifically, it is possible to adopt construction in which grounding is possible from the same power source to the intermediate transfer member, the cleaning roll abutting against the intermediate transfer member, and the cleaning brush abutting against the intermediate transfer member through an electrical resistor or a zener diode, or a construction in which bias voltage is supplied from the power source through an electrical resistor or a diode.

Further, the potential gradient forming unit can apply biases of the same polarity (positive or negative) to the intermediate transfer member, the cleaning roll abutting against the intermediate transfer member, and the cleaning brush abutting against the intermediate transfer member. It is possible to adopt a construction in which the cleaning member (the cleaning roll or the cleaning brush) does not come into contact with the final transfer member, or a construction in which the cleaning member (the cleaning roll or the cleaning brush) does not come into contact with the image bearing member. By thus constructing the image forming apparatus, it is only necessary to prepare a positive or a negative power source, which contributes to a reduction in apparatus size and is advantageous in terms of cost.

In accordance with the present invention, it is possible to provide an image forming apparatus in which an increase in the service life of the intermediate transfer member and a reduction in apparatus size and cost are mutually compatible and which involves as little deterioration in productivity in image formation as possible.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Preferred embodiments of the present invention will now be described in detail.

Embodiment 1

Figure 1:
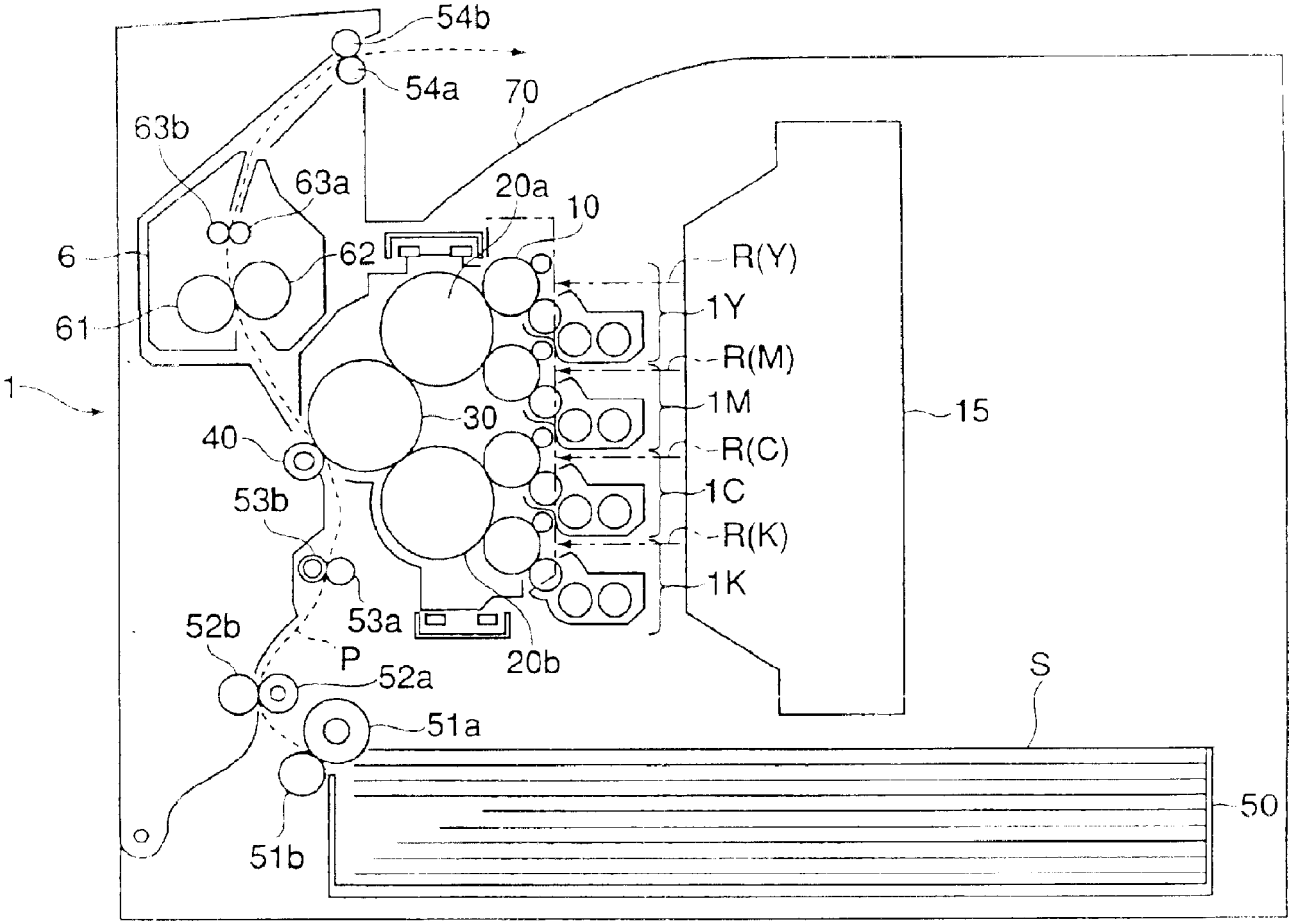
FIG. 1 is a schematic sectional view of a full color printer according to Embodiment 1 of the present invention.
Figure 2:
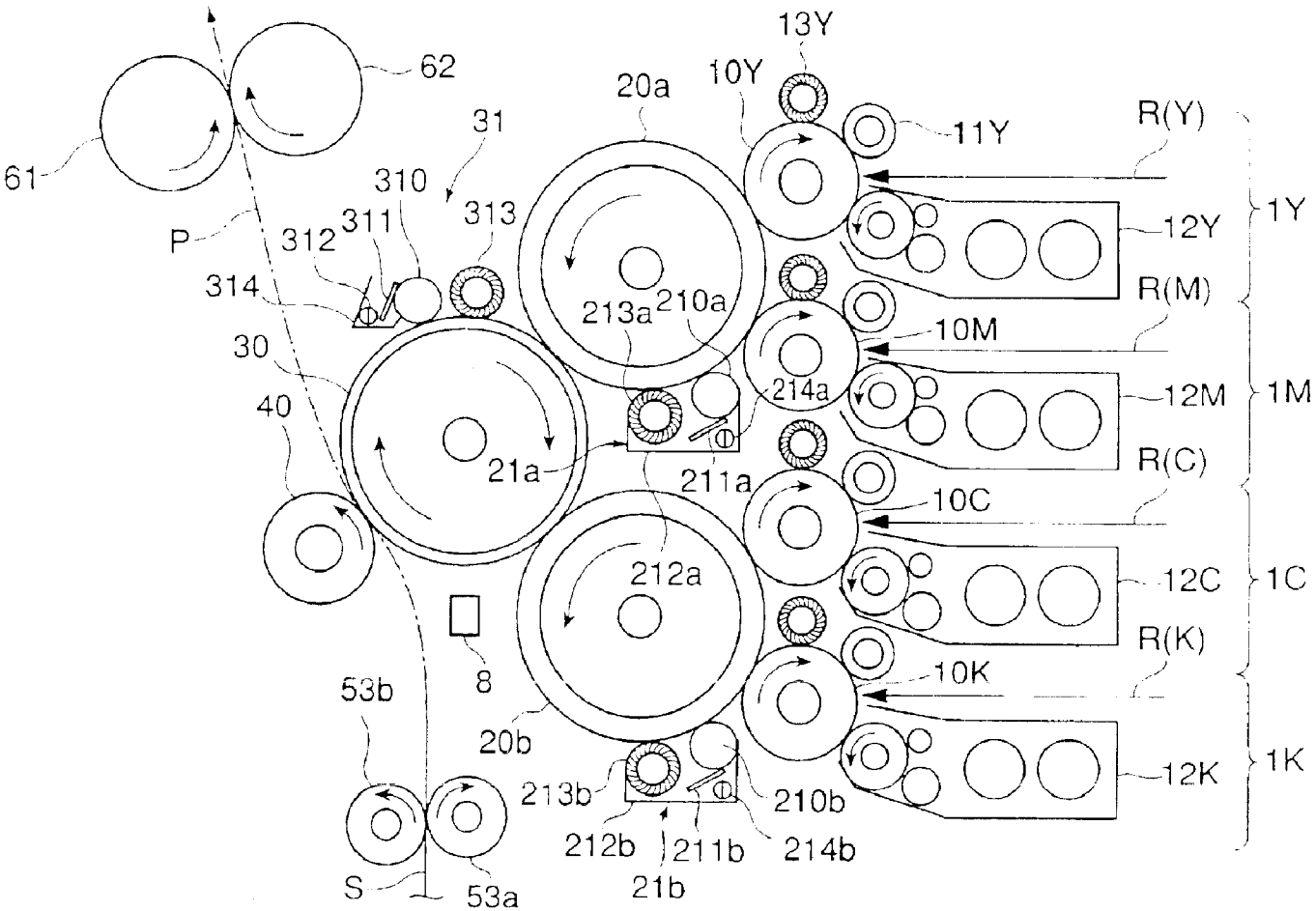
FIG. 2 is a main-portion sectional view of the full color printer of Embodiment 1 of the present invention.

FIG. 1 shows a tandem type full color printer (image forming apparatus) according to Embodiment 1 of the present invention. FIG. 2 shows a main image forming portion of the full color printer (image forming apparatus) shown in FIG. 1.

This full color printer is roughly composed of an image forming portion, an intermediate transfer device, a final transfer roll 40, a fixing device 6, and a sheet feeding portion.

The image forming portion is composed of four image forming units (image forming means) 1Y through 1K for yellow (Y), magenta (M), cyan (C), and black (K), and an exposure device 15. The image forming units 1Y through 1K are respectively composed of four photosensitive drums (image bearing members) 10Y through 10K, charging rolls (contact type charging members) 11Y through 11K which are respectively in contact with the photosensitive drums 10Y through 10K, developing devices 12Y through 12K respectively opposed to the photosensitive drums 10Y through 10K, and photosensitive brush rolls 13Y through 13K which are respectively in contact with the photosensitive drums 10Y through 10K.

Here, regarding the arrangement of the members around the photosensitive drum 10, a charging roll 11, a developing device 12 (the developing sleeve of a developing device), a first intermediate transfer roll (described below), and a photosensitive brush roll 13 are arranged around each photosensitive drum 10 from the upstream side to the downstream side with respect to the rotating direction of the photosensitive drum 10. The photosensitive brush roll 13 is formed by winding a flocked tape of conductive resin spirally around a roll-shaped base member of metal (stainless steel)

A DC voltage of approximately −900 V is applied to the photo sensitive drums 10Y through 10K by the charging rolls 11Y through 11K, whereby the drums are uniformly charged to approximately −380 V; when electrostatic latent images are written thereto by the exposure device 15, the surface potential thereof is reduced to approximately −70 V.

Each of the developing devices 12Y through 12K is a magnetic-brush-contact, two-component development type developing device equipped with a developing roll, a developer amount regulating member, a developer carrying member, and an auger for carrying and agitating developer. The amount of developer regulated by the developer amount regulating member and carried to the developing portion is approximately 30 to 40 g/m$^2$; at this time, the charge amount of the toner existing on the developing roll is approximately −20 to −40 $\mu$C/g. An AC+DC developing voltage is applied to these developing devices 12Y through 12K to execute development; this developing voltage is composed of an AC component of approximately 4 kHz and 1.6 kVpp, and a DC component of approximately −300 V.

The intermediate transfer device is equipped with a first upstream side intermediate transfer roll (first upstream side intermediate transfer member) 20*a* which is in contact with the photosensitive drums 10Y and 10M at a primary transfer position, a first downstream side intermediate transfer roll (first downstream side intermediate transfer member) 20*b* which is in contact with the photosensitive drums 10C and 10K at a primary transfer position, a second intermediate transfer roll 30 which is in contact with the two first intermediate transfer rolls 20*a* and 20*b* at a secondary transfer position respectively, and a toner sensor 8 which detects optically and in a non-contact fashion the presence and density of a toner image on the second intermediate transfer roll 30.

Further, the first upstream side intermediate transfer roll 20*a* is equipped with a cleaning device (cleaning unit) 21*a*. This first upstream side cleaning device 21*a* is equipped with a metal (stainless steel) cleaning roll (downstream side cleaning roll) 210*a* which is in contact with the first upstream side intermediate transfer roll 20*a*, a metal (stainless steel) cleaning blade 211*a* abutting against the cleaning roll 210*a*, a screw auger (conveyance mechanism) 214*a* which carries residual toner scraped off by the cleaning blade 211*a* to a toner recovery box (not shown) outside the upstream side cleaning device 21*a*, an intermediate transfer brush roll (downstream side cleaning brush) 213*a* which is in contact with the intermediate transfer roll 20*a* in the vicinity of the upstream side of the cleaning roll 210*a* with respect to the rotating direction of the first upstream side intermediate transfer roll 20*a*, and a cleaner housing (accommodating member) 212*a* accommodating the cleaning roll 210*a*, the cleaning blade 211*a*, the screw auger 214*a*, and the intermediate transfer brush roll 213*a*. The intermediate transfer brush roll 213*a* is formed by spirally winding a flocked conductive resin tape around a roll-shaped metal (stainless steel) base member.

Similarly, the first downstream side intermediate transfer roll 20*b* is equipped with a cleaning device (cleaning unit) 21*b*. This first upstream side cleaning device 21*b* is equipped with a metal (stainless steel) cleaning roll (downstream side cleaning roll) 210*b* which is in contact with the first downstream side intermediate transfer roll 20*b*, a metal (stainless steel) cleaning blade 211*b* abutting the cleaning roll 210*b*, a screw auger (conveyance mechanism) 214*b* which carries residual toner scraped off by the cleaning blade 211*b* to a toner recovery box (not shown) outside the upstream side cleaning device 21*b*, an intermediate brush roll (downstream side cleaning brush) 213*b* which is in contact with the intermediate transfer roll 20*b* in the vicinity of the upstream side of the cleaning roll 210*b* with respect to the rotating direction of the first downstream side intermediate transfer roll 20*b*, and a cleaner housing (accommodating member) 212*b* accommodating the cleaning roll 210*b*, the cleaning blade 211*b*, the screw auger 214*b*, and the intermediate transfer brush roll 213*b*. The intermediate transfer brush roll 213*b* is formed by spirally winding a flocked conductive resin tape around a roll-shaped metal (stainless steel) base member.

The second intermediate transfer roll 30 is equipped with a cleaning device (cleaning unit) 31. This second cleaning device 32 is equipped with a metal (stainless steel) cleaning roll (upstream side cleaning roll) 310 in contact with the second intermediate transfer roll 30, a metal (stainless steel) cleaning blade 311 abutting the cleaning roll 310, a screw auger (conveyance mechanism) 314 which carries residual toner scraped off by the cleaning blade 311 to a toner recovery box (not shown) outside the upstream side cleaning device 31, an intermediate transfer brush roll (upstream side cleaning brush) 313 which is in contact with the intermediate transfer roll 30 in the vicinity of the downstream side of the cleaning roll 310 with respect to the rotating direction of the second intermediate transfer roll 30, and a cleaner housing (accommodating member) 312 accommodating the cleaning roll 310, the cleaning blade 311, the screw auger 314, and the intermediate transfer brush roll 313. The intermediate transfer brush roll 313 is formed by spirally winding a flocked conductive resin tape around a roll-shaped metal (stainless steel) base member.

Regarding the arrangement of the members around the first upstream side intermediate transfer roll 20*a*, the photosensitive drum 10M, the photosensitive drum 10Y, the second intermediate transfer roll 30, the intermediate transfer brush roll 213*a*, and the cleaning roll 210*a* are arranged around the first upstream side intermediate transfer roll 20*a* from the upstream side to the downstream side with respect to the rotating direction of the first upstream side intermediate transfer roll 20*a*. Further, regarding the arrangement of the members around the first downstream side intermediate transfer roll 20*b*, the photosensitive drum 10K, the photosensitive drum 10C, the second intermediate transfer roll 30, the intermediate transfer brush roll 213*b*, and the cleaning roll 210*b* are arranged around the first downstream side intermediate transfer roll 20*b* from the upstream side to the downstream side with respect to the rotating direction of the first downstream side intermediate transfer roll 20*b*. Further, regarding the arrangement of the members around the second intermediate transfer roll 30, the first upstream side intermediate transfer roll 20*a*, the first downstream side intermediate transfer roll 20*b*, the toner sensor 8, the final transfer roll 40, the cleaning roll 310, and the intermediate transfer brush roll 313 are arranged around the second intermediate transfer roll 30 from the upstream side to the downstream side with respect to the rotating direction of the second intermediate transfer roll 30.

Each of the first intermediate transfer rolls 20*a* and 20*b* is formed by providing a silicone rubber layer (conductive elastic layer) on a metal pipe, and forming thereon a high release coating layer (resistance layer having a higher electric resistance compared to the conductive elastic layer); while the acceptable resistance value thereof normally ranges from $10^5$ to $10^9$ Ω, in this example, it is approximately $10^8$ Ω. And, the requisite surface potential for transferring toner images from the photosensitive drums 10Y through 10K to the first intermediate transfer rolls 20*a* and 20*b* normally ranges from approximately +250 through 500 V, and an optimum potential value can be set according to the toner charging condition, the ambient temperature, the humidity, etc. Like the first intermediate transfer rolls 20*a* and 20*b*, the second intermediate transfer roll 30 is formed by providing a silicone rubber layer (conductive elastic layer) on a metal pipe and forming thereon a high release coating layer (resistance layer having a higher electric resistance compared to the conductive elastic layer); while the acceptable resistance value thereof normally ranges from $10^8$ to $10^{12}$ Ω, in this example, it is approximately $10^{11}$ Ω (That is, it exhibits a resistance value higher than that of the first intermediate transfer rolls 20*a* and 20*b*). And, the requisite surface potential for transferring toner images from the first intermediate transfer rolls 20*a* and 20*b* to the second intermediate transfer roll 30 normally ranges from approximately +600 through 1200 V, and an optimum potential value can be set according to the toner charging condition, the ambient temperature, the humidity, etc.

The final transfer roll (final transfer member) 40 is in contact with the second intermediate transfer roll 30 at the final transfer position, and formed by providing an urethane rubber layer on a metal pipe and providing thereon a resin coating layer; while the acceptable resistance value thereof normally ranges from $10^6$ to $10^9$ Ω, in this example, it is approximately $10^8$ Ω (That is, it exhibits a resistance value lower than that of the second intermediate transfer roll 30). And, the transfer voltage to be applied to this final transfer roll 40 in order to transfer a toner image from the second intermediate transfer roll 30 to the sheet S (recording sheet) normally ranges from approximately +1200 through 5000 V, and an optimum voltage value can be set according to the ambient temperature, the humidity, the kind of sheet S (the resistance value thereof, etc.), etc. In this example, the constant current system is adopted, and approximately +6 μA is applied under normal temperature and normal humidity to obtain a substantially appropriate final transfer voltage of approximately +1600 to 2000 V.

Further, (unlike the first intermediate transfer rolls 20*a* and 20*b* and the second intermediate transfer roll 30), the final transfer roll 40 is not caused to abut against the cleaning roll (cleaning member). Further, (exclusive of the time when replacing the image forming unit and inclusive of the times when the apparatus is in the image formation mode, the process control mode, and the cleaning mode), the final transfer roll 40 comes into contact with the second intermediate transfer roll 30, and requires no special retracting mechanism or the like.

The surface roughness (Rz) of the final transfer roll 40 may be 20 [μm(Rz)] or less, for example, 10 [μm(Rz)], and the surface roughness (Rz) of the first and second intermediate transfer rolls 20*a*, 20*b*, and 30 may be 10 [μm(Rz)] or less, for example, 1 [μm(Rz)]. Further, the final transfer roll 40 exhibits a higher degree of surface roughness (Rz) than the first and second intermediate transfer rolls 20*a*, 20*b*, and 30. It is desirable that the surface roughness of these rolls be not more than the average grain size of the toner forming the toner image.

In the fixing device 6, a heating roll 62 and a pressurizing roll 61 are held in press contact with each other to form a fixing nip. Arranged in the heating roll 62 is a halogen lamp (not shown) serving as the heat source; at the time of fixing, the surface of the heating roll 62 is heated to a predetermined fixing temperature. Further, on the downstream side of the fixing nip with respect to the direction in which the sheet S is transported, there is arranged fixing/discharge roll pair 63*a* and 63*b*.

The sheet feeding portion is formed along the transport path (indicated by the dotted line) P for the sheet S extending from the sheet feeding tray 50 to the discharge tray 70. The sheet feeding tray 50 accommodates plural sheets S, and from the sheet feeding tray 50 to the downstream side of the transport path, there are sequentially arranged a roll pair formed by a pick-up roll 51*a* and a retarding roll 51*b*, a pair of transport rolls 52*a* and 52*b*, a pair of registration rolls 53*a* and 53*b*, and (on the downstream side of the final transfer roll 40 and the fixing device 6) a pair of discharge rolls 54*a* and 54*b*.

Figure 3:
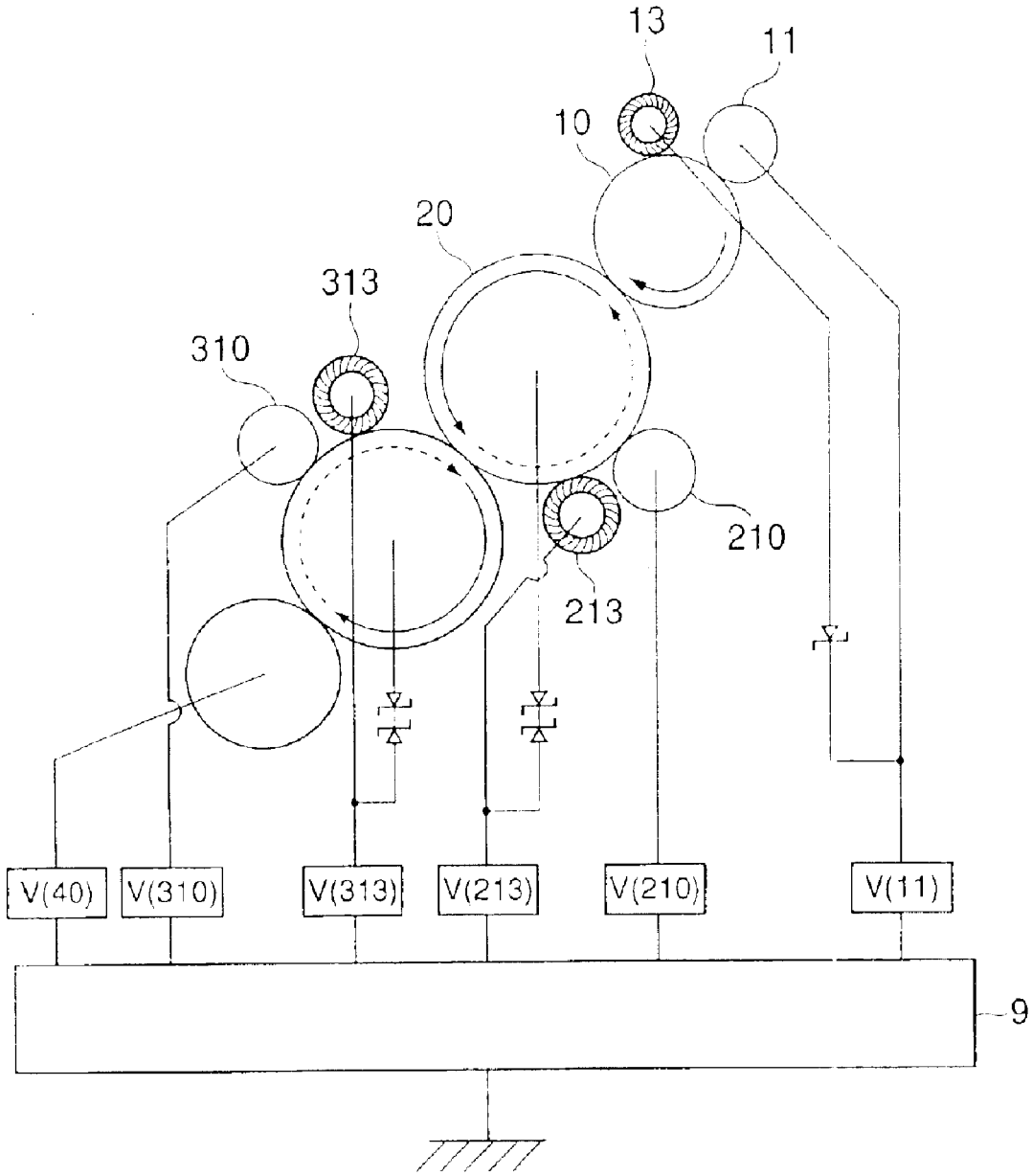
FIG. 3 is a block diagram illustrating a potential gradient control system of the full color printer of Embodiment 1 of the present invention.

FIG. 3 is a block diagram illustrating the potential control system of this full color printer 1. According to the situation the color printer 1 is in, that is, according to whether the printer is in the print mode (image formation mode), the process control mode, or the cleaning mode, the potential control portion (potential gradient forming unit) 9 controls the voltages to be applied to the charging roll 11, the photosensitive brush roll 13, the first intermediate transfer rolls 20*a* and 20*b*, the cleaning roll 210, the intermediate transfer brush roll 213, the second intermediate transfer roll 30, the cleaning roll 310, the intermediate transfer brush roll 313, and the final transfer roll 40, with the result that it forms an appropriate potential gradient according to the situation the full color printer 1 is in between the charging roll 11, the photosensitive brush roll 13, the first intermediate transfer rolls 20*a* and 20*b*, the cleaning roll 210, the intermediate transfer brush roll 213, the second intermediate transfer roll 30, the cleaning roll 310, the intermediate transfer brush roll 313, and the final transfer roll 40. In this embodiment, by using a zener diode, the bias voltage supplied from the same power source is applied to plural members after being transformed into appropriate bias voltages.

The operation of this full color printer 1 will now be described.

TABLE 1

| | V(40) | V(310) | V(313) | V(213) | V(210) | V(11) |
|---|---|---|---|---|---|---|
| Print | 2000 | 1200 | 1300 | 800 | 100 | −900 |

Given in Table 1 are the bias voltages to be applied, in the print mode, by the potential control portion 9 of this embodiment to the charging rolls 11, the cleaning roll 210, the intermediate transfer brush roll 213, the cleaning roll 310, the intermediate transfer roll 313, and the final transfer roll 40.

Figure 4:
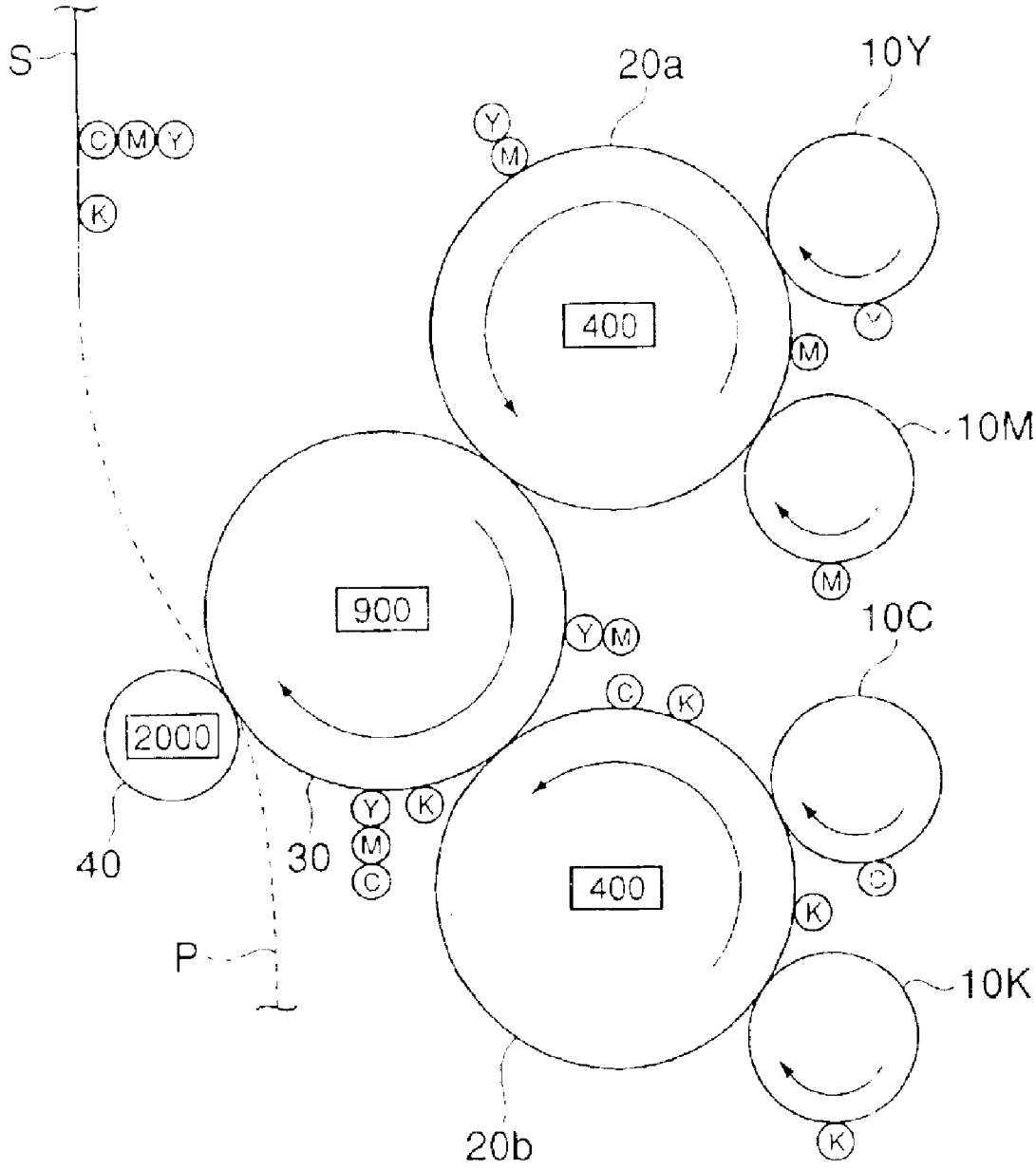
FIG. 4 illustrates how a toner image as an output image moves in the full color printer of Embodiment 1 of the present invention.

FIG. 4 illustrates how the toner image as the output image moves. In the drawing, the solid-line arrow indicates the movement path of the toner image as the output image. The toner used in this embodiment is negatively charged toner. That is, the normal-polarity toner is negatively charged, and the reverse-polarity toner is positively charged.

Yellow, magenta, cyan, and black toner images are respectively formed on the photosensitive drums 10Y through 10K by the image forming units 1Y through 1K. That is, the surface of each photosensitive drum 10 is uniformly charged by the charging roll 11, and a laser beam R corresponding to the output image is applied from the exposure device 15 to the surface of the photosensitive drum 10 after the charging, forming an electrostatic latent image on the photosensitive drum 10 through a difference in potential between the exposed portions and the unexposed portions. The developing device 12 imparts toner selectively to this electrostatic latent image to thereby form a toner image on the photosensitive drum 10.

Then, a magenta toner image is primarily transferred to the first upstream side intermediate transfer roll 20*a* from the photosensitive drum 10M for magenta. Further, a yellow toner image is primarily transferred to the first upstream side intermediate transfer roll 20*a* from the photosensitive drum 10Y for yellow, and superimposed on the magenta toner image. Similarly, a black toner image is primarily transferred to the first downstream side intermediate transfer roll 20*b* from the photosensitive drum 10K for black. Further, a cyan toner image is primarily transferred to the first downstream side intermediate transfer roll 20*b* from the photosensitive drum 10C for cyan.

The primarily transferred magenta and yellow toner images are secondarily transferred to the second intermediate transfer roll 30. The primarily transferred black and cyan toner images are also secondarily transferred to the second intermediate transfer roll 30, where the cyan toner image is superimposed on the magenta and yellow toner images secondarily transferred previously to thereby form a full color toner image on the second intermediate transfer roll 30.

The full color toner image and the black toner image, which are secondarily transferred, reach the nip portion between the second intermediate transfer roll 30 and the final transfer roll 40. In synchronism with the timing of their reaching, the sheet S as the recording sheet is transported to the nip portion from the registration roll pair 53*a* and 53*b* (See FIG. 1), and the full color toner image and the black toner image are tertiarily (finally) transferred to the sheet S.

Thereafter, this sheet S passes the nip portion of the heating roll 62 and the pressurizing roll 61 of the fixing device 6 (See FIG. 1). In this process, by the action of the heat and pressure imparted from the rolls 61 and 62, the full color toner image and the black toner image are fixed to the sheet S to become a permanent image. Thereafter, the sheet S is discharged onto the discharge tray 70 by the discharge roll pair 54*a* and 54*b* to complete the full color image formation.

Figure 5:
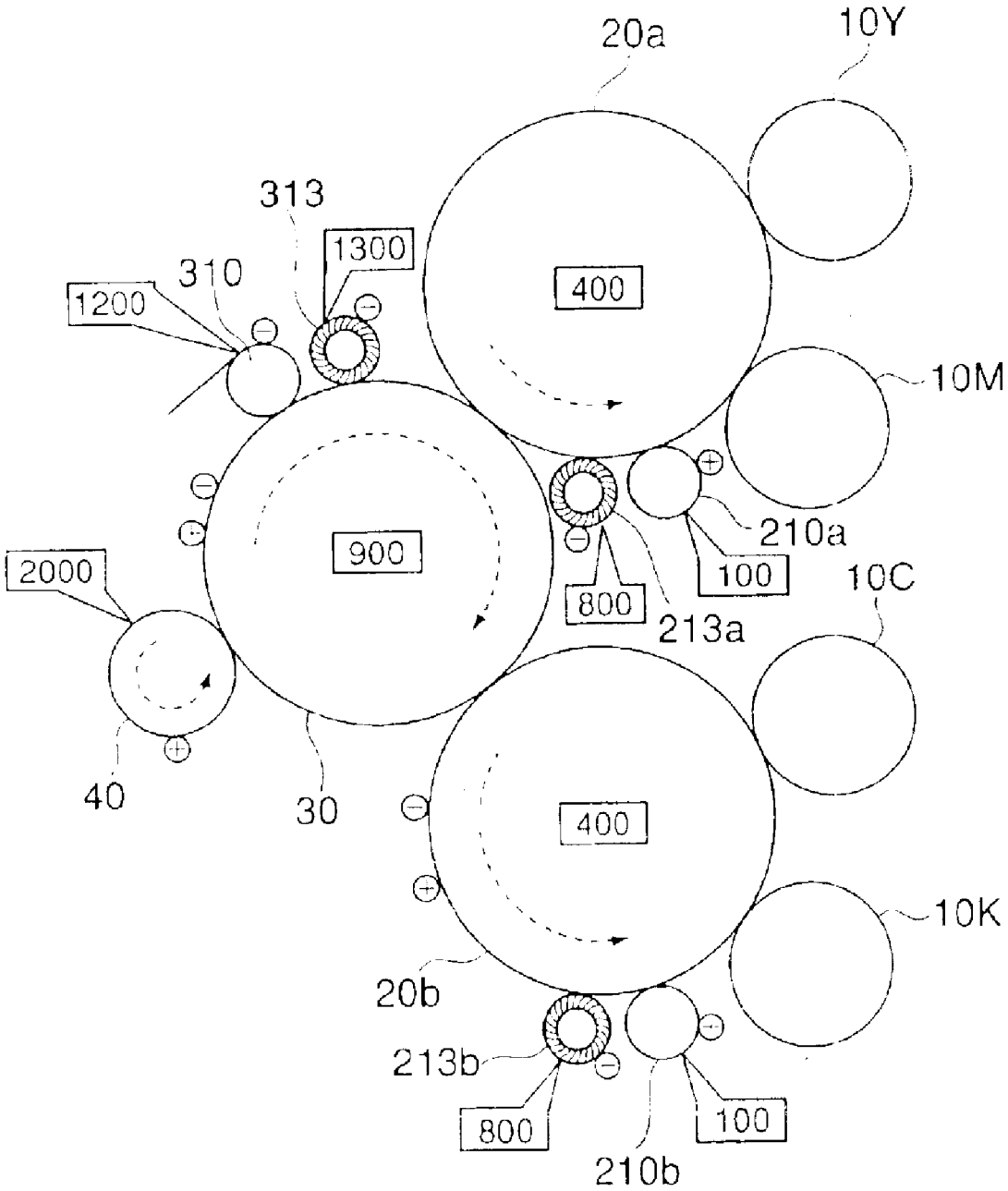
FIG. 5 illustrates how residual toner that has not been transferred moves in the full color printer of 1 of the present invention.

FIG. 5 illustrate show residual toner, which is not transferred and is remaining on the intermediate transfer roil, and the final transfer roll moves.

The potential of the cleaning roll 310 is higher than that of the second intermediate transfer roll 30, so that negatively charged normal-polarity residual toner adheres to the cleaning roll 310. On the other hand, the potential of the intermediate transfer brush roll 313 is higher than that of the second intermediate transfer roll 30, so that lowly and negatively charged normal-polarity residual toner that has failed to adhere to the cleaning roll 310 adheres to the intermediate transfer brush roll 313.

The potential of the cleaning roll 210*a* is lower than that of the first upstream side intermediate transfer roll 20*a*, so that positively charged reverse-polarity residual toner adheres to the cleaning roll 210*a*. On the other hand, the potential of the intermediate transfer brush roll 213*a* is higher than that of the first upstream side intermediate transfer roll 20*a*, so that negatively charged normal-polarity residual toner adheres to the cleaning roll 210*a*. Similarly, the potential of the cleaning roll 210*b* is lower than that of the first downstream side intermediate transfer roll 20*b*, so that positively charged reverse-polarity residual toner adheres to the cleaning roll 21*b*. On the other hand, the potential of the intermediate transfer brush roll 213*b* is higher than that of the first downstream side intermediate transfer roll 20*b*, so that negatively charged normal-polarity residual toner adheres to the cleaning roll 210*b*.

Modification

In the full color printer 1 of Embodiment 1, it is also possible to omit the cleaning roll 210*b*.

Embodiment 2

While the full color printer 1 of Embodiment 1 has as the intermediate transfer device plural (three) intermediate transfer members: the first upstream side intermediate transfer roll 20*a*, the first downstream side intermediate transfer roll 20*b*, and the second intermediate transfer roll 30, the monochrome printer 1 of this embodiment has as the intermediate transfer device only one intermediate transfer roll 20. The components that are the same as those of the full color printer 1 of Embodiment 1 are indicated by the same reference numerals, and a description thereof will be omitted.

In the following, the operation of this monochrome printer 1 will be described.

Figure 6:
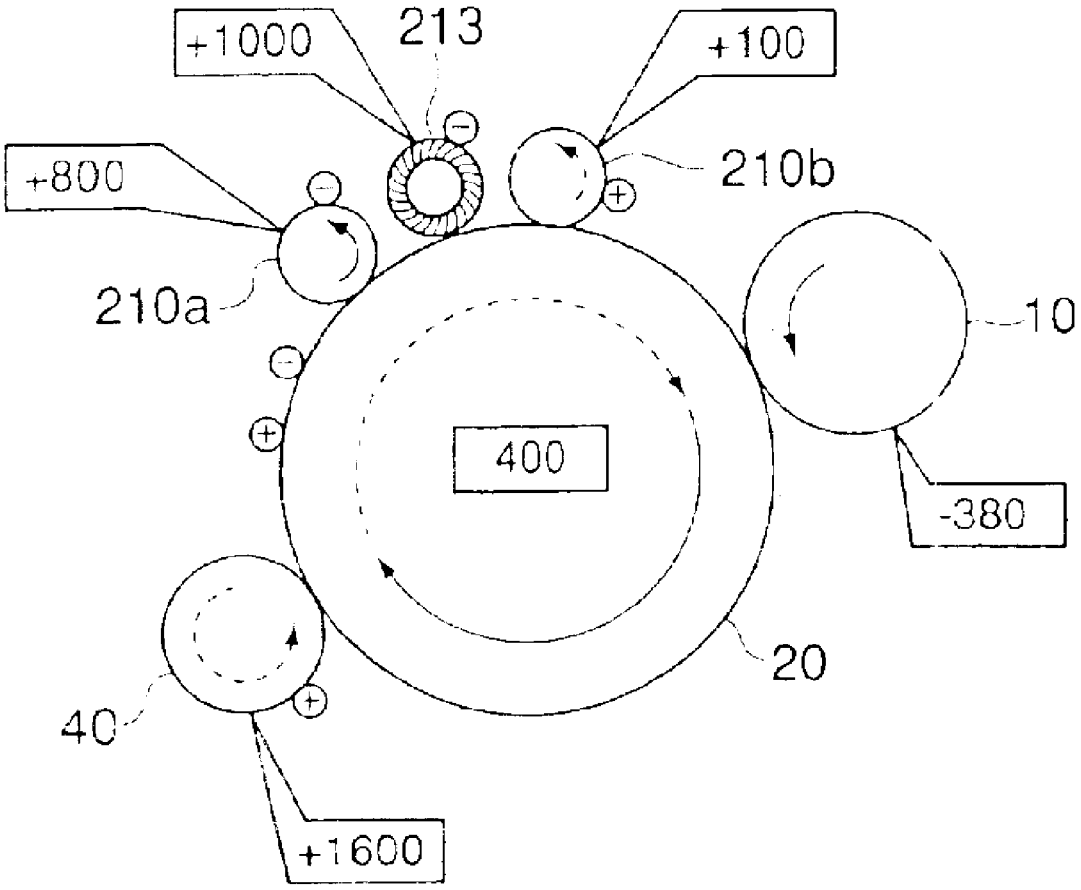
FIG. 6 illustrates how residual toner that has not been transferred moves in a full color printer according to Embodiment 2 of the present invention.

FIG. 6 illustrates how residual toner, which is not transferred and is remaining on the intermediate transfer roll, and the final transfer roll moves. Since the potential of the cleaning roll 210*a* (the upstream side cleaning roll) is higher than that of the intermediate transfer roll 20, negatively charged normal-polarity residual toner adheres to the cleaning roll 210*a*. On the other hand, the potential of the intermediate transfer brush roll 213 is still higher than that of the intermediate transfer roll 20, so that lowly charged normal-polarity residual toner that has failed to adhere to the cleaning roll 210*a* adheres to the intermediate transfer brush roll 213. Since the potential of the cleaning roll (downstream side cleaning roll) 210*b* is lower than that of the intermediate transfer roll 20, positively charged reverse-polarity residual toner adheres to the cleaning roll 210*b*. The magnitudes of the biases to be applied to the cleaning roll 210*a* and the cleaning roll 210*b* may be reversed.

What is claimed is:

1. An image forming apparatus, comprising:

an image bearing member;

an image forming unit which forms a toner image on a surface of the image bearing member;

an intermediate transfer device having at least one intermediate transfer member and which is in contact with the image bearing member at a primary transfer position;

a final transfer member which is in contact with the intermediate transfer device at a final transfer position;

a potential gradient forming unit which forms a potential gradient between the image bearing member, the at least one intermediate transfer member, and the final transfer member so as to transfer the toner image to the final transfer position; and a cleaning unit which removes residual toner on the at least one intermediate transfer member that is not finally transferred to a recording sheet at the final transfer position, wherein the cleaning unit includes:

an upstream side cleaning roll which is in contact with the at least one intermediate transfer member;

a downstream side cleaning roll which is in contact with the at least one intermediate transfer member on the downstream side of the upstream side cleaning roll with respect to a feedback direction in which the residual toner is fed back from the final transfer position to the primary transfer position; and a cleaning brush which is in contact with the at least one intermediate transfer member on the downstream side of the upstream side cleaning roll with respect to the feedback direction and on the upstream side of the downstream side cleaning roll with respect to the feedback direction.

2. An image forming apparatus according to claim 1, wherein the upstream side cleaning roll and the downstream side cleaning roll are all formed of conductive members, and wherein the potential gradient forming unit applies to one cleaning roll a high cleaning roll bias voltage higher than a surface potential of the intermediate transfer member which is in contact with the cleaning roll, and applies to the other cleaning roll a low cleaning roll bias voltage lower than the surface potential of the intermediate transfer member which is in contact with the cleaning roll.

3. An image forming apparatus according to claim 1, wherein the upstream side cleaning roll, the downstream side cleaning roll, and the cleaning brush are all formed of conductive members, wherein the potential gradient forming unit applies to one cleaning roll a high cleaning roll bias voltage higher than a surface potential of the intermediate transfer member which is in contact with the cleaning roll, and applies to the other cleaning roll a low cleaning roll bias voltage lower than the surface potential of the intermediate transfer member which is in contact with the cleaning roll, and wherein the potential gradient forming unit applies to the cleaning brush a cleaning brush bias voltage which is on the side closer to the side of the cleaning roll bias voltage to be applied to the upstream side cleaning roll as compared with the surface potential of the intermediate transfer member which is in contact with the cleaning brush.

4. An image forming apparatus according to claim 1, wherein of the at least one intermediate transfer member, the downstream side cleaning roll which is in contact with the at least one intermediate transfer member, and the cleaning brush which is in contact with the at least one intermediate transfer member at least two receive application of bias voltage from the same power source.

5. An image forming apparatus according to claim 1, which is a monochrome image forming apparatus.

6. An image forming apparatus according to claim 1, wherein the potential gradient forming unit can apply biases of the same polarity (positive or negative) to the intermediate transfer member, the cleaning roll abutting against the intermediate transfer member, and the cleaning brush abutting against the intermediate transfer member.

7. An image forming apparatus according to claim 1, in which the cleaning roll or the cleaning brush does not come into contact with the final transfer member.

8. An image forming apparatus according to claim 1, in which the cleaning roll or the cleaning brush does not come into contact with the image bearing member.

* * * * *